United States Patent [19]

Watson

[11] 4,238,185

[45] Dec. 9, 1980

[54] CONTROL SYSTEM FOR A BURNER

[75] Inventor: Kenneth Watson, Croydon, England

[73] Assignee: Telegan Limited, Surrey, England

[21] Appl. No.: 907,722

[22] Filed: May 19, 1978

[30] Foreign Application Priority Data

May 25, 1977 [GB] United Kingdom ..... 22156/77
Mar. 9, 1978 [GB] United Kingdom ..... 9414/78

[51] Int. Cl.[3] ..... F23N 5/00
[52] U.S. Cl. ..... 431/76; 236/15 E
[58] Field of Search ..... 431/12, 75, 76, 89, 431/90; 236/15 E

[56] References Cited

U.S. PATENT DOCUMENTS

| | | | |
|---|---|---|---|
| 3,404,836 | 10/1968 | Hickam | 236/15 E |
| 3,503,553 | 3/1970 | Shomaker | 236/15 E |
| 3,549,089 | 12/1970 | Hamlett | 431/12 |
| 3,616,274 | 10/1971 | Eddy | 431/76 |
| 3,947,217 | 3/1976 | Graat et al. | 431/12 |
| 4,150,939 | 4/1979 | Hayes | 431/76 |

FOREIGN PATENT DOCUMENTS

| | | | |
|---|---|---|---|
| 2461565 | 6/1976 | Fed. Rep. of Germany | 431/76 |
| 2304034 | 10/1976 | France | 431/76 |

*Primary Examiner*—Carroll B. Dority, Jr.
*Assistant Examiner*—Lee E. Barrett
*Attorney, Agent, or Firm*—Oblon, Fisher, Spivak, McClelland & Maier

[57] ABSTRACT

This invention is a control for a burner enabling it to operate efficiently with very little excess air but providing a main control for the fuel and for the combustion air in response to demand, and an auxiliary control in response to the amount of free oxygen in the products of combustion. The latter quantity can be measured by a zirconia cell, and there are means for controlling its temperature accurately so that the reading is reliable. The controls in response to demand and excess air respectively are applied alternately in a cycle with a period of no control to enable the effect of an adjustment to be established before further control is applied.

10 Claims, 7 Drawing Figures

CONTROL SYSTEM FOR A BURNER

BACKGROUND OF THE INVENTION

1. Field of the Invention

This invention relates to a control system for a burner and one object of the invention is to provide means for automatically controlling operation of the burner so that the excess air as actually measured is maintained close to a desired value.

2. Description of the Prior Art

It is usual to operate boilers by controlling the fuel supply and the air supply independently in stoichiometric proportions, although it is necessary to have some excess air to ensure that combustion is complete even if the air and fuel are not perfectly mixed. Excess air however requires to be heated without producing any useful effect, and therefore represents a loss of efficiency, and the smallest amount of excess air that can be used while ensuring that there is complete combustion, the more efficient will the boiler be. The expression 'boiler' includes such similar pieces of apparatus as hot air or gas generators and ovens.

SUMMARY OF THE INVENTION

According to the present invention, a control system for a burner having means for controlling the fuel and/or the air supply automatically, includes also means responsive to the amount of oxygen in the products of combustion from the burner for providing an additional control, The additional control can be used to control the air supply to the burner, whether by use of the usual air damper, or an additional damper, and it has been discovered that efficient control of a boiler can best be achieved if the two controls, namely the control in response to steam demand or steam pressure on the one hand, and the control in response to oxygen content of the products of combustion on the other hand, are not used simultaneously, but successively in continuous control cycles.

Thus a control cycle could consist of a first period during which control is in response to steam pressure or steam demand, and a further period during which control is in response to the oxygen level in the exhaust gases. There is preferably also a time delay period between the first and second periods to allow the result of any adjustment in the first period to be reflected in the exhaust gas duct before the second period commences.

In order to have reasonably precise control even with a very rapid increase in steam demand, it has been found desirable to have at least six control cycles in a minute; and one 10 second cycle, convenient for many boilers, consists of a two or three second period during which control is in response to steam demand, or steam pressure, a delay of five or six seconds during which there is no control, and a further period of two or three seconds during which control is in response to the oxygen level in the exhaust gases. Those cycles are automatically repeated one after another, and conveniently they are effected by a pair of electrical switches cam operated from a common timer motor shaft for connecting the respective control system to their actuators.

An existing boiler will usually have its own automatically operated fuel control in response to steam demand, and a mechanical linkage for automatically adjusting the air damper as the fuel supply is adjusted. That kind of boiler can be modified to take advantage of the present invention by the addition of an upstream trim damper controlling the air supply to the main damper fan, which trim damper is opened or closed in response to the oxygen content of the exhaust gases falling below or increasing above a pre-set narrow range.

Alternatively, it can be arranged that the steam demand signal is used to control the fuel supply and air supply until the air supply gets within, say, 5 millimeters of the demanded air supply in accordance with a pre-set control system, and then the signal from the oxygen detector can be arranged to take over control of the single air damper and to continue to provide fine control until the air supply departs by at least the 5 millimeters from the programmed supply, in which case control will revert to being in response to steam demand.

Even with that system, control will be intermittent so that after any adjustment of a fuel valve or an air damper, there will be a period of no control for the effect of the adjustment to be observed before further control is applied. That intermittent or impulsed system tends to prevent the system hunting.

In order to allow for a quick shut-down, it may be arranged that the intermittent control of the fuel valve is only when the demand is increasing and that control can be continuous when shutting down.

There may also be a safety device responsive to the steam pressure dropping below a predetermined danger level for switching the trim damper to the fully open position, and allowing the fuel increase control to be continuous rather than intermittent.

The means responsive to the level of oxygen may consist of a zirconia cell in the boiler stack which can give an electrical signal representing the amount of oxygen present in the exhaust gases in the stack which is a direct measure of the amount of excess air being supplied to the boiler.

It has been discovered that for most effective control, and for protection of the zirconia cell, the temperature of the cell should be maintained very close to a predetermined temperature of about 700° C. Substantial variation of the cell temperature will affect the output so that it will no longer accurately represent the amount of free oxygen around the cell, and may cause damage to the cell.

Thus a heater for a zirconia cell may be arranged to be switched to one or other of two states, in dependence on the temperature of the cell, so as to heat the cell if the temperature is lower than one limit and to allow the cell to cool if it is above that limit or above a higher limit.

It is possible that the two states are respectively close in which the heater is energised and not energised, but in a preferred system the two states are ones in which the heater is an electrical heater, which is respectively energised from higher and lower voltages, the lower voltage being such that the cell will cool slowly.

As the cell temperature varies between higher and lower limits, a relay or the equivalent can be arranged to be operated and released to connect the heater alternately to the two different voltage supplies.

The two temperature limits might be as close as, say 695° C., and 700° C., which has been found to allow the zirconia cell to give a sufficiently accurate measure of the amount of free oxygen in the exhaust stack of a boiler to be controlled. The system has the advantage that it is reasonably cheap, and reliable.

A thermo-couple is conveniently provided adjacent the zirconia cell, for giving an electrical signal dependent upon the cell temperature, and in a preferred embodiment of the invention that signal is compared with a reference signal in a controller for operating and releasing a switch as the signal varies between limits corresponding to the two temperature limits. There is then preferably a second level switch arranged to operate if the cell temperature drops below a lower predetermined value, if for example, there is a fault in the system, or when the boiler is starting up. Operation of the second level switch can be arranged to switch in an indicating lamp, or the equivalent. If that happens, the circuit is conveniently arranged automatically to drive the trim damper to the fully open position to give a fail safe feature to the operation of the boiler.

The various relays described might be electromechanical relays or might be solid state relays.

Although the invention has been described as being particularly applicable to the control of the combustion of a boiler, it is also applicable to the control of the temperature of a zirconia cell for measuring the amount of free oxygen in other applications, for example, in the application for controlling a processing oven, described in British Patent Specification No. 49004/77.

BRIEF DESCRIPTION OF THE DRAWINGS

The invention may be carried into practice in various ways, and one embodiment will be described by way of example with reference to the accompanying drawings, in which.

DETAILED DESCRIPTION OF THE PREFERRED EMBODIMENTS

Figure 1:
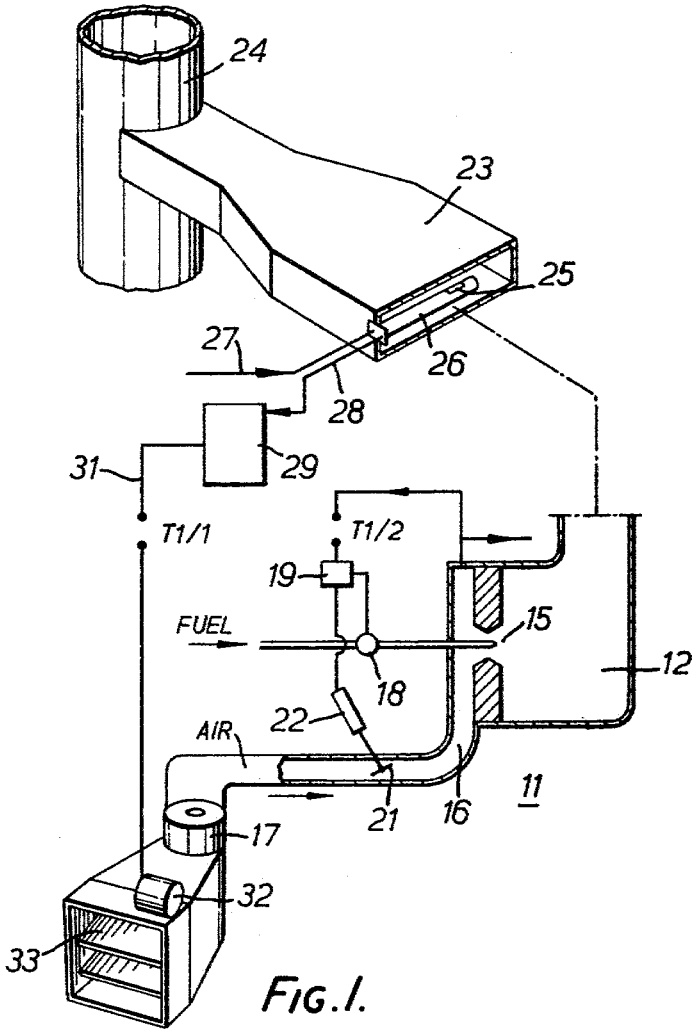
FIG. 1 is a sketch of a boiler control system embodying the invention.

In FIG. 1, the control system is applied to a conventional oil or gas fired shell boiler 11 having a combustion chamber 12, a fuel injector 15, a combustion air duct 16, and a forced air draught fan 17. The rate of supply of fuel to the injectors 15 depends upon the setting of a fuel valve 18 driven by an actuator 19, and the rate of supply of air to the air duct is controlled by a damper 21 which is operated from the actuator 19 through a mechanical linkage 22 incorporating a cam designed so that the air fuel ratio is approximately as desired over the total operating range. The uptake from the combustion chamber 12 is fed through a duct 23 to the exhaust stack 24.

That kink of boiler is well known. The acutator 19 operates in response to the steam pressure in the output line and so operates in response to demand to increase the fuel supply if the steam pressure drops because the demand increases.

The system is not very accurate because of variations in fuel, pressure, viscosity, and calorific value, and because of lost motion in the linkage 22, and varying combustion air density and stack draught resulting from changes in ambient conditions.

It is dangerous and inefficient if complete combustion does not take place, and accordingly it is the practice to provide a certain percentage of excess air, but as that escapes carrying heat with it, the more excess air, the less efficient is the boiler.

It is now possible to measure the amount of excess air quite accurately by having a zirconia cell 25 in a probe 26 mounted in the duct 23. If the cell is maintained consistently at a temperature of about 700° C. (say within 5° C. of the nominal temperature), such a cell produces an E.M.F. which accurately reflects the relative amounts of oxygen on opposite sides of a partition in the cell. The exhaust gases in the duct 23 pass over one side of the partition, and a reference atmospheric supply at 27 passes over the other side, and an output signal at 28 representing the amount of oxygen in the duct 23 is fed to a metering device 29 which has a pointer moving over a linear or non-linear scale indicating the amount of excess oxygen. The meter can be set with selected high and low excess air levels, and as soon as the pointer moves from the chosen region between the marks, a contact 131 or 132 (FIG. 2) is closed depending upon whether the excess air drops below the desired range or rises above it.

When that occurs, an electrical signal is fed at 31 to an actuator motor 32 for driving a trim damper 33 to vary the air supply to the forced draught fan 17 for supplying air to the boiler. If the contact 132 operates because there is too much excess air in the duct, the sense of the signal to the motor 32 will be such as to tend to close the trim damper 33 and vice-versa.

Figure 3:
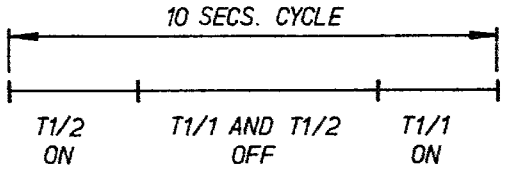
FIG. 3 is a diagram showing the sequence of the timer switches in the circuit of FIG. 2.
Figure 2:
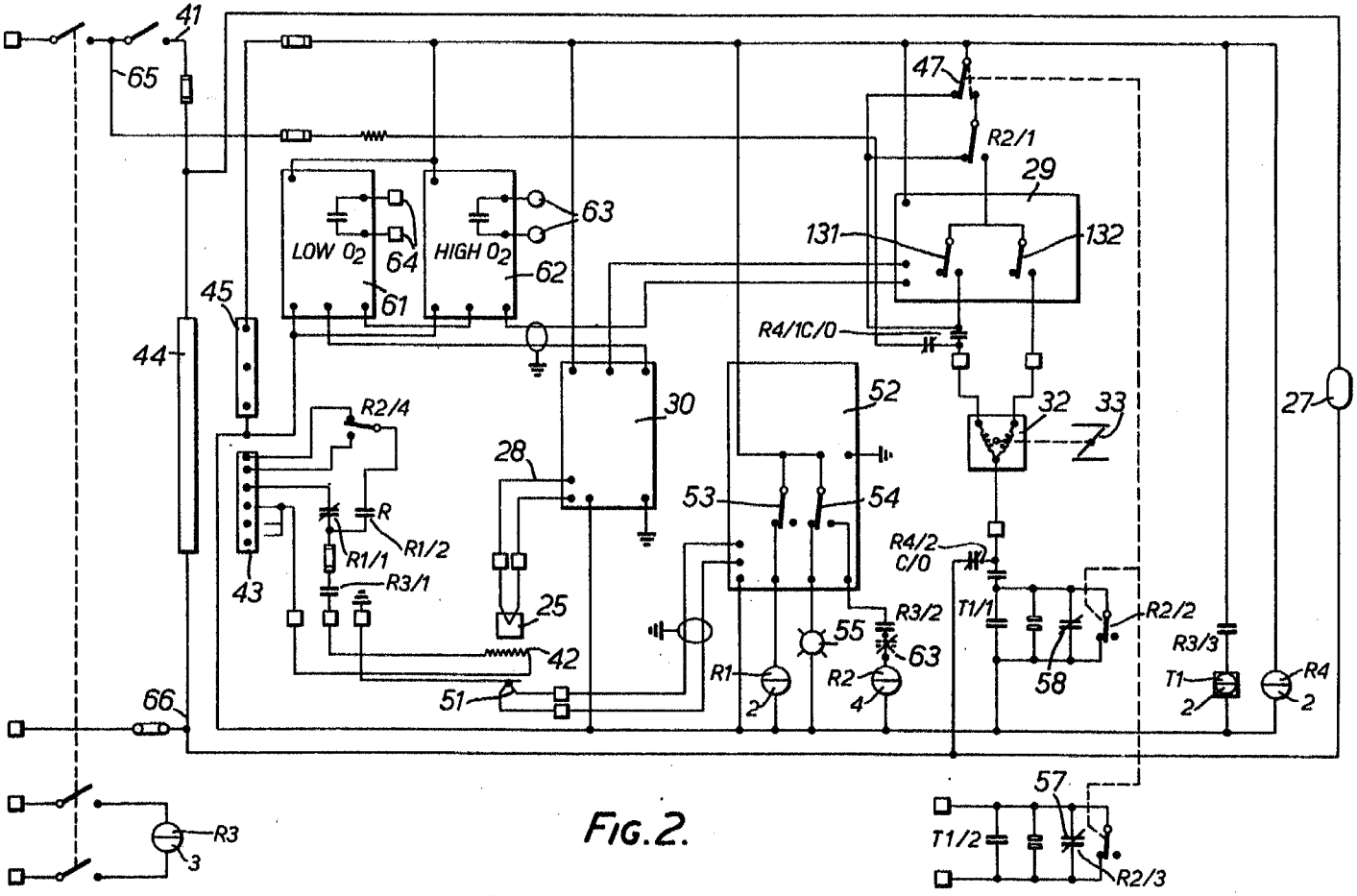
FIG. 2 is a circuit diagram of the system in FIG. 1.

Of course, the existing fuel and air control system from the actuator 19 may operate in accordance with changing steam demand without causing the amount of excess air to pass beyond the desired range, and then it is unnecessary for the trim damper 33 to be operated, but it has been discovered that it is important to allow a time lag after any operation of the acutator 19, so that the effect can be reflected in the duct 23 before the zirconia cell 25 comes into operation, and accordingly the control system has a time sequencing arrangement as will now be described in more detail with reference to FIGS. 2 and 3.

When the control system is switched on by closing a mains switch 41, provided the boiler has already been ignited, a relay R3 will be energised, and that first of all closes its contact R3/1 to energise a heater 42 for the zirconia cell which requires to be at about 700° C. to operate. The heater is driven from one secondary winding 43 of a mains transformer 44. The other secondary winding 45 provides the power supply to the rest of the control system. Relay R3/2 closes, and contact R3/3 also closes at switching on to energise an impulse timer T1, which will be described in more detail below.

The heater 42 is connected, when relay contacts R3/1 are closed, either to a 65 volts tapping of the winding 43, or to a 90 volts tapping in dependence on whether a relay R1 is not energised, or is energised. That relay has normally-closed contacts R1/1 in series with the 65 volts tapping, and normally-open contacts R1/2 in series with the 90 volts tapping. The precise voltages applied to the heater 42 are not important provided one is sufficient to raise the temperature of the cell 25 slowly, while the other is low enough to allow the temperature of the cell to drop slowly.

The temperature of the cell, or of the probe in which it is mounted, is measured by a thermo-couple 51 which provides an electrical input signal to a 2-level controller 52 having a pair of change-over contacts. The main contact 53 is open or closed, according as the input signal from the thermo-couple 51 is above a value of say 28 m.volts corresponding to a temperature of 700° C., or below a value of 27 m.volts, corresponding to a temperature of 695° C. When the contact 53 is closed the relay R1 is energised so that the heater is heated from the 90 volts tapping of the winding 43, and starts to increase the temperature of the cell. When the temperature reaches 700° C., and the signal from the thermo-couple reaches 28 m.volts, the contact 53 opens and the relay R1 is de-energised so that continued energisation of the heater 42 is from the lower volts tapping, which allows the cell temperature to drop slowly until at 695° C. the contact 53 closes again.

In that way the temperature of the cell can be maintained very close to its set value, by repeated switching of the switch 53 and the relay contacts R1.

The second switch 54 of the controller is arranged to be closed to energise a low temperature indicating lamp 55, whenever the input from the thermocouple 51 indicates a temperature of less than 650° C. a condition which will arise during start up of the system, or if the heater fails, or the thermo-couple fails. Closing of the switch 54 opens its connection through normally-open relay contacts R3/2, and the operating winding of a relay R2 which when de-energised allows the damper motor 32 to be energised through contacts R2/1, and R2/2 to drive the trim damper 33 to its fully open position for safety.

During starting, before the contact 54 switches over at 650° C., the relay R2 will not be energised and the heater will be supplied through a contact R2/4 from a 110 volts tapping on the winding 43 to get rapid initial heating. When contact 54 switches over, R2 operates through contacts R3/2 and switches over contacts R2/4 so that the heater is energised from the normal high (90) volts tapping.

The other side of the heater 42 can be connected to the 0, 5, or 10 volts tapping of the winding 43 in dependence on the maximum stack temperature of the particular installation, so that the effective heater voltages during starting, and in the 698° C. and 700° C. conditions, can be all adjusted together.

A relay R4 operates at switching on, so that with the switch 47 on 'AUTO' the metering device 29 is by-passed by change-over contacts R3/1 and R4/2 to connect the motor 32 to drive the damper 33 fully open.

When R2 is energised at 650° C. contacts R2/1 change over and control of the motor 32 is by the device 29.

Also, contacts R2/2 and R2/3 open so that control by the device 29 can only occur when contact T1/1 of the timer $T_1$ are closed.

The position of the contacts T1/1 and T1/2 of the timer $T_1$ are shown in FIG. 1, and it can be seen that the trim damper actuator 32, and the fuel actuator 19 can only operate in response to demand signals when their respective timer contact are closed. During starting they were shorted by the relay contacts R2/2 and R2/3.

Under automatic operation, the impulse timer T1 operates in 10 second cycles, that is at 6 cycles per minute. The precise length of each part of the cycle will depend upon the particular application, but in a typical example, as shown in FIG. 3, for the first two seconds the contact T1/2 is closed so that the fuel actuator 19 can respond to a steam demand signal, and can reset the rate of fuel supply at 18, and the rate of air supply at 21 through the mechanical linkage 22 if the demand makes that necessary. There is then a delay of four or five seconds while both contacts T1/2 and T1/1 are open, so that no further control can be applied, and that allows the effect of any adjustment of the actuator 19 to be reflected in the duct at 23 by a change in the excess air as measured by the oxygen detector in the form of the zirconia cell 25. The the contact T1/2 is closed by the impulse timer T1 so that the output signal from the zirconia cell can be used to drive the damper motor actuator 32 if any adjustment is necessary. It will be clear that if the meter pointer at 29 has not gone outside the desired excess air range at either end, neither of the switches 131 and 132 will have closed, and therefore neither of the motor 32 windings will be energised.

If, however, the oxygen content indicates, for example that there is insufficient excess air, the movement of the pointer will cause the switch 131 to close, to connect the trim damper motor 32 in the sense to open the trim damper 33 to increase the air supply. However that signal can only be applied to the motor 32 for the interval of two or three seconds during which the contact T1/1 is closed.

Thereafter the cycle repeats with the contact T1/1 opening, and the contact T1/2 closing.

It will be observed that the control by way of the actuator 19 acts in pulses of two or three seconds in a ten second cycle so that after any adjustment of the existing air/fuel control actuator 19, there is a time delay to enable that adjustment to take effect before any signal from the zirconia cell can order an adjustment of the trim damper 33, and before a further adjustment by the actuator 19 can be made.

This arrangement tends to prevent hysteresis and it has been found to be capable of controlling the amount of excess air within very fine limits, so that is is always sufficient for safety, but never so great as to make the boiler run inefficiently. A substantial fuel saving can be achieved by use of the control system which is a very simple addition to an existing boiler.

Thus it is only necessary to insert the zirconia cell in its probe in the duct 23, and to connect it to the meter 29, and fit and connect the trim damper 33 and its actuator 32.

It has been found that even if there is a very quick demand for more steam, a 10 second cycle is quite sufficient.

In some applications the intermittent control of the existing actuator 19 is only used for an increasing steam demand since if the demand decreases it may be desirable to shut down the boiler as fast as possible, and then the timer contacts T1/2 would be by-passed at 57. However, intermittent control of the trim damper through the timer contact T1/1 would continue even during reduction of the fuel supply.

If the steam pressure were to drop below a recognised danger level, a pressure switch (not shown) is arranged to trip relay R2 causing the trim damper motor 32 to drive continuously to the position in which the damper is fully open to provide the maximum amount of air, and at the same time the intermittent fuel control contacts T1/1 would be by-passed at 58.

The zirconia cell 25 at a certain temperature produces an output in millivolts which increases with decreasing amounts of free oxygen in the stack, and the output is supplied to the metering device 29 through an amplifier 30 having a reverse characteristic so that the output to the device 29 decreases from 20 to 4 milliamps as the input from the cell 25 increases from 15 to 112 millivolts corresponding to a decrease in oxygen concentration from 10% to 0.1% The relationship is not linear, and the device 29 has a logarithmic characteristic.

The output from the amplifier 30 is fed to the device 29 through the inputs of two amplifiers 61 and 62 in series. If the signal is greater than 12 milliamps corresponding to 14% oxygen, the amplifier 62 trips normally-closed contacts 63 in series with the relay R2, so that R2/1 and R2/2 change over, and the damper 33 is driven to be fully open in a 'fail-safe' condition.

That would occur if the signal from the cell 25 was lost due to a short circuit or an open circuit.

If the cell heater 42 or the thermocouple 51 became open circuited, a low temperature signal at 52 would also release the relay R2.

A low oxygen signal from the amplifier 30 will cause the amplifier 61 to give an output at 14 to switch off the burner.

Failure of the supply downstream of the mains switch 41 will release the relay R4 so that it contacts change over and the damper motor 32 is connected across the supply at 65, 66, and drives the damper to the fully open position.

Figure 4:
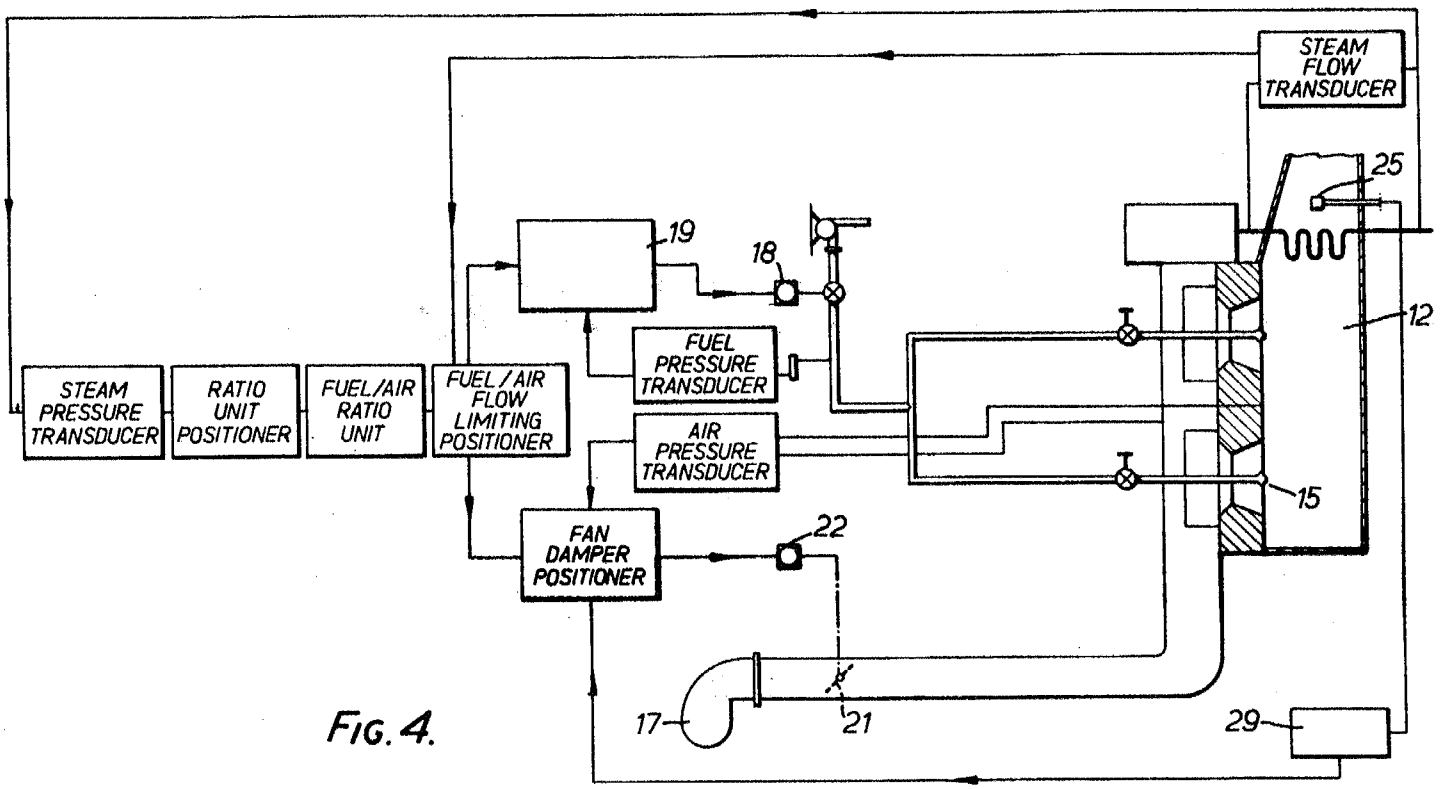
FIG. 4 is a general arrangement drawing of another boiler control system to which the invention could be applied.

The invention could also be applied to the type of boiler conrol system described in British Patent Specification No. 14091/74, a diagram of which is shown in FIG. 4 of this specification.

Many of the components correspond with those in FIG. 1, but it will be seen that there are separate fuel valve actuators and damper actuators, each responsive to its own fuel or air pressure transducer. A steam pressure transducer controls the fuel/air ratio unit and that in turn controls a fuel and air flow limiting positioner for controlling the fuel valve positioner and the fan damper positioner independently in accordance with the particular requirements. The complete operation is described in more detail in Specification No. 14091/74, but that specification does not teach the use of the zirconia cell oxygen analyser 25 which can provide an additional signal as an input to the fan damper positioner, so that the operation of the damper actuator can depend upon the oxygen level in the stack, as well as upon the air pressure in the boiler, and the signal from the fuel and air flow limiting positioner. With that additional control in the refined system of FIG. 4 it will not be necessary to have the additional trim damper 33, since a single damper can be set to take account of both the optimum air/fuel ratio in dependence upon steam demand, and the actual measured excess air in the stack. It is arranged that control is in response to the set air pressure as long as the actual pressure is more than 5 millimeters from the set pressure; once the actual pressure gets closer to the set pressure, control is switched to be from the oxygen detector 25 in the stack.

In each case, the control signal is only used periodically with a delay for any adjustment to take effect before further control is applied.

In some applications, the pressure of the trim damper 33 upstream of the main damper 21 can reduce the amount of air available, for example for a secondary air supply to the burners at 15 from upstream of the damper 21.

If so, the damper 31 can be omitted and a passage may be inserted by-passing the damper 21 and containing a trim damper controlled in the same way as the damper 31.

Thus fine control of the air supply can be achieved, while yet there is no restriction on the air available at the entrance to the main damper 21.

Figure 5:
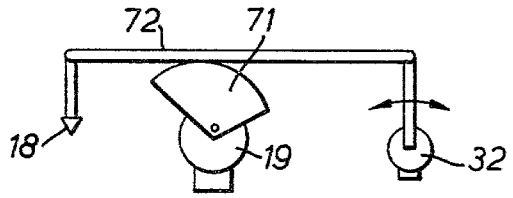
FIG. 5 is a sketch of a modified fuel valve and air damper actuator.

In a modification shown in FIG. 5, the motor 19 controls the fuel valve 18 directly, and the air damper 21 through a cam 71 and a lever 72, the relationship between the two controls being set by the shape of the cam which determines the length of the lever arm. Then the motor 32 can be arranged to move the end of the lever 72 to right or left in FIG. 5 to adjust the effective length of the lever arm. The motors 19 and 32 will operate intermittently in the cycle of FIG. 3.

Figure 6:
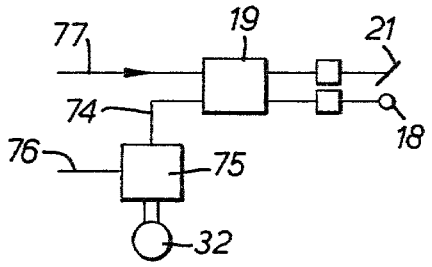
FIG. 6 is a schematic view of another modification of the fuel valve and air damper actuator.

In another modification shown diagrammatically in FIG. 6, the demand signal at 77 is a pneumatic signal and is used to drive a pneumatic actuator 19 which operates actuators for the air damper and fuel valve 21 and 18 in dependence on a reference pneumatic signal at 74. That can be varied by adjusting the setting of a variable pressure drop device 75 in a line from a reference pressure source 76. The device 75 is driven by the motor 32.

Some shell type or fire tube boilers have separate burners and separated passages for combustion gases. They should have individual zirconia cells and burner controls for each burner.

If such a boiler has separate burners and a common gas passage, it would not be simple to control both burners in response to the oxygen level in the combustion gases, but the signal from the zirconia cell could be used to control a damper at the boiler outlet, perhaps between an economiser and the stack.

Figure 7:
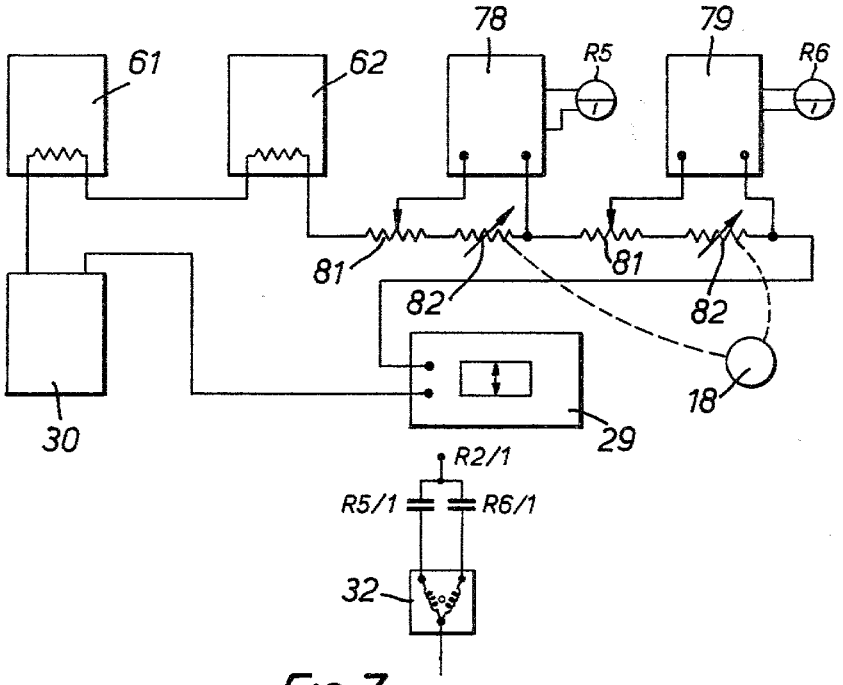
FIG. 7 is an enlarged schematic view of certain components of FIG. 2, with modifications.

Finally in the modification of FIG. 2 shown in FIG. 7 means are provided for effectively varying the settings of the contacts 131, and 132 which determine the selected high and low excess air levels, the variation being automatic in response to adjustment of the boiler firing load.

In the embodiment described with reference to FIG. 2, the excess oxygen level in the products of combustion is maintained more or less within a fixed range of perhaps about 3% from full burner firing load down to perhaps 30% load when the damper is fully open. For lower burner loads than that, the percentage of excess air increases up to perhaps 7%, and that can be tolerated because burner rarely operate at those low loads, although the burning is inefficient, and white smoke is generated.

Most burners are not capable of efficient combustion with low excess air levels at low firing loads, but a new burner is now available which can operate with excess oxygen of about 0.5% at full burner load, and about 1.6% at a low burner load, and with such a burner it is desirable to adjust the high and low excess settings in dependence on the burner load, and hence upon the burner fuel valve setting.

FIG. 7 shows certain components of FIG. 2 and the modifications necessary to bring this about. The switches 131, and 132 are omitted, and instead relays R5 and R6 each have a single normally open contact respectively in the open and close lines to the damper motor 32. The relays R5 and R6 are operated by respective trip amplifiers 78 and 79 connected in series with the control line from the amplifier 32 to the device 29 by way of the amplifiers 61 and 62.

The output from the amplifier 30 is connected to the indicating device 29 through the inputs of the amplifiers 61 and 62 in series, and through a potentiometer 81 and a variable resistor 82 in series for each of the amplifiers 78 and 79. The current in the circuit represents the input to the device 29, and the voltage inputs to the amplifiers 78 and 79 depend upon the product of that current and the particular resistance across which the amplifier input is connected. The potentiometers 81 are set so that the amplifiers operate their respective relays R5 and R6 at two different current levels in the circuit representing the high and low excess air settings for a particular burner load. The tappings of the resistors 82 are driven from the fuel valve actuator 18, so that as the fuel valve setting is changed to change the burner load, the low and high excess air settings are also changed up or down together. Whenever the oxygen level produces a current in the output from the amplifier 30 outside the set range for that burner load, the relay R5 or the relay R6 will operate to cause the motor 32 to open or close the trim damper 33.

In that way, the excess oxygen level in the products of combustion could be controlled fairly accurately to be close to a figure which varies between, say about 0.5% and 1.6% over a burner setting from full load to perhaps 30% load.

I claim:

1. A burner control system for optimizing the fuel and air supplied to a burner, comprising:
   - a fuel control;
   - an air control responsive to the fuel control;
   - demand responsive means for controlling the fuel control and air control;
   - oxygen sensing means for sensing the amount of oxygen in the products of combustion from the burner and producing an oxygen signal;
   - additional burner control means responsive to the oxygen signal for further adjusting air to the burner to optimize the ratio of fuel to air supplied for combustion;
   - a substantially continuously running timer; and
   - switch means connected with the timer for cyclical operation to first render the demand responsive means operative, then render both the demand responsive means and additional control means inoperative to provide time for stabilization of combustion following operation of the demand responsive means, and then render the additional control means operative for additional adjustment as necessary, and for thereafter repeating the cycle.

2. A system as claimed in claim 1 including means for controlling the fuel and the air supply together in a predetermined relationship.

3. A system as claimed in claim 2 in which the additional control means adjusts the predetermined relationship.

4. A system as claimed in claim 1 used in combination with a burner having an automatically operated fuel control in response to demand and a linkage for automatically adjusting an air damper as the fuel supply is adjusted, the system including a trim damper controlling the air supply to the air damper, which trim damper is opened or closed in response to the additional control means.

5. A system as claimed in claim 4 in which the trim damper is upstream of the air damper in an air passage containing the air damper.

6. A system as claimed in claim 1 in which the additional control means is only operative while the air supply is within a predetermined range of a demanded air supply.

7. A system as claimed in claim 6 in which means automatically rests the range in response to changing burner load.

8. A system as claimed in claim 1 in which a burner stack leads from the burner and the oxygen sensing means responsive to the amount of oxygen in the products of combustion comprises a zirconia cell in the burner stack arranged to give an electrical signal representing the amount of oxygen in the exhaust gases in the stack.

9. A system as claimed in claim 8 including a heater for the zirconia cell arranged to be switched to one or other of two states in dependence on the temperature of the cell so as to heat the cell if the temperature is lower than one limit, and to allow the cell to cool if it is above that limit or above a higher limit.

10. A burner control system for optimizing the fuel and air supplied to a burner, comprising:
   - a fuel control;
   - an air control responsive to the fuel control;
   - demand responsive means for controlling the fuel control and air control;
   - oxygen sensing means for sensing the amount of oxygen in the products of combustion from the burner and producing an oxygen signal;
   - additional burner control means responsive to the oxygen signal for further adjusting air to the burner to optimize the ratio of fuel to air supplied for combustion;
   - a substantially continuously running timer; and
   - switch means connected with the timer for cyclical operation to first render the demand responsive means operative, then render one of the demand responsive means and additional control means inoperative to provide time for stabilization of combustion following operation of one of the control means, and then render the additional control means operative for additional adjustment as necessary, and for thereafter repeating the cycle.

* * * * *